US010196830B2

(12) United States Patent
Kreller

(10) Patent No.: US 10,196,830 B2
(45) Date of Patent: Feb. 5, 2019

(54) TRUSS FRAME, MODULAR TRUSS GIRDER AND BRIDGING AND/OR SUPPORT CONSTRUCTION

(71) Applicant: Wilhelm Layher Verwaltungs-GmbH, Gueglingen-Eibensbach (DE)

(72) Inventor: Helmut Kreller, Bad Rappenau (DE)

(73) Assignee: Wilhelm Layher Verwaltungs-GmbH, Guelingen-Eibensbach (DE)

( * ) Notice: Subject to any disclaimer, the term of this patent is extended or adjusted under 35 U.S.C. 154(b) by 0 days.

(21) Appl. No.: 15/542,518

(22) PCT Filed: Jan. 27, 2016

(86) PCT No.: PCT/DE2016/100030

§ 371 (c)(1),
(2) Date: Jul. 10, 2017

(87) PCT Pub. No.: WO2016/138889

PCT Pub. Date: Sep. 9, 2016

(65) Prior Publication Data

US 2018/0266123 A1 Sep. 20, 2018

(30) Foreign Application Priority Data

Mar. 5, 2015 (DE) ..... 10 2015 103 209

(51) Int. Cl.
*E01D 6/00* (2006.01)
*E04G 1/14* (2006.01)
(Continued)

(52) U.S. Cl.
CPC ..... *E04G 1/14* (2013.01); *E01D 6/00* (2013.01); *E04G 5/165* (2013.01); *E04G 7/307* (2013.01); *E01D 2101/30* (2013.01)

(58) Field of Classification Search
CPC ..... E04G 1/14; E04G 5/165; E04G 5/307; E01D 6/00; E01D 2101/30
(Continued)

(56) References Cited

U.S. PATENT DOCUMENTS 879,524 A * 2/1908 Collins ..... E01D 15/00 14/4
4,017,932 A * 4/1977 Lotto ..... E01D 15/127 14/2.4
(Continued)

FOREIGN PATENT DOCUMENTS

DE 24 39 273 A1 3/1976
DE 10 2009 021 424 A1 11/2010
EP 2 253 764 A2 11/2010

OTHER PUBLICATIONS

International Search Report of PCT/DE2016/100030, dated Jun. 15, 2016.

*Primary Examiner* — Raymond W Addie
(74) *Attorney, Agent, or Firm* — Collard & Roe, P.C.

(57) ABSTRACT

A truss frame for a bridge and/or support includes two elongated, parallel longitudinally-extending post pipes having an outer circumference; two parallel crossbars extending perpendicularly to the post pipes; and a length-adjustable elongated diagonal element. The parts are hingedly and detachably bolted to one other. Two parallel connecting plates secured near each post pipe end extend away from one another on a common, imaginary plane containing the post pipe and crossbar longitudinal axes. Each crossbar and diagonal element has opposite ends hingedly and detachably bolted to a connecting plate. At least two rosettes are welded to each post pipe at a distance from one another corresponding to an integer multiple of a module scaffold modular size. A connecting body is welded to the connecting plate near at
(Continued)

least two post pipe ends associated with the same crossbar and surrounds the respective post pipe outer circumference.

12 Claims, 5 Drawing Sheets

(51) Int. Cl.
*E04G 5/16* (2006.01)
*E04G 7/30* (2006.01)
*E01D 101/30* (2006.01)

(58) Field of Classification Search
USPC ..... 14/74.5, 77.1, 78, 3, 5
See application file for complete search history.

(56) References Cited

U.S. PATENT DOCUMENTS 5,042,101 A * 8/1991 Huether ..... E01D 15/124 14/2.4
7,028,442 B2 * 4/2006 Merrifield ..... B64G 1/222 52/114

* cited by examiner

Fig. 2
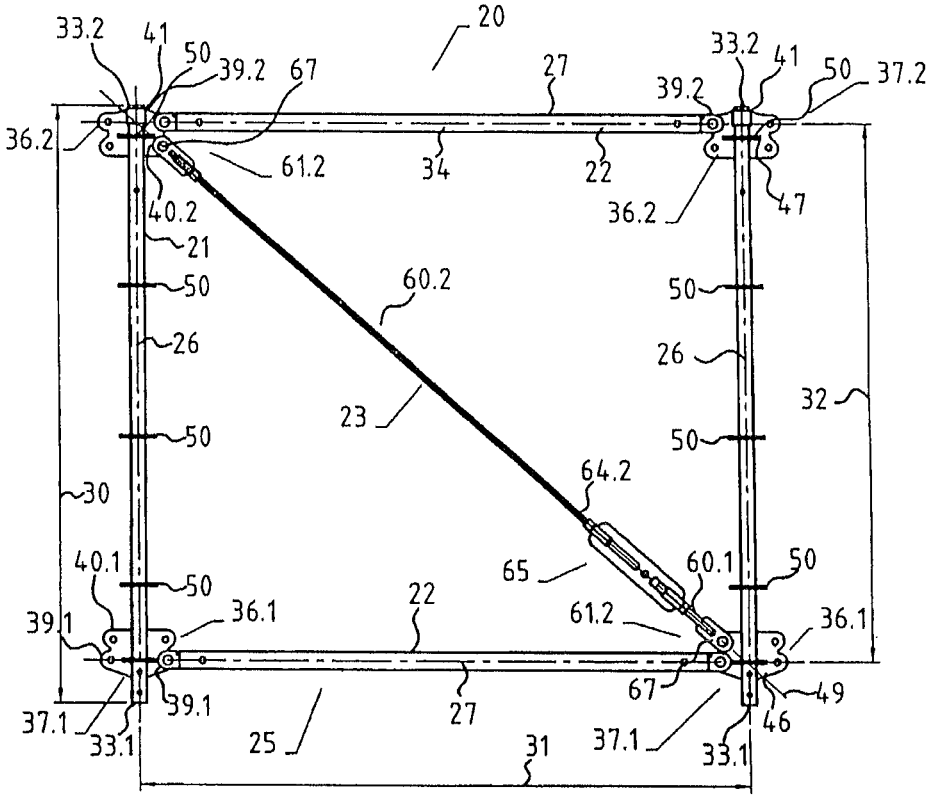
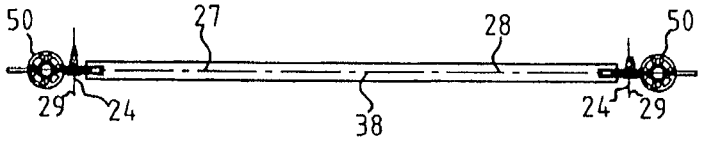
Fig. 4

TRUSS FRAME, MODULAR TRUSS GIRDER AND BRIDGING AND/OR SUPPORT CONSTRUCTION

CROSS REFERENCE TO RELATED APPLICATIONS

This application is the National Stage of PCT/DE2016/100030filed on Jan. 27, 2016, which claims priority under 35 U.S.C. § 119 of German Application No. 10 2015 103 209.0 filed on Mar. 5, 2015, the disclosure of which is incorporated by reference. The international application under PCT article 21(2) was not published in English.

The invention relates to a truss frame for construction of a bridging and/or support construction, particularly for construction of a modular truss girder for a bridging and/or support construction or of a bridging and/or support construction, for example pedestrian bridge, catwalk, platform or scaffolding or underpinning for a scaffolding or of a scaffolding, substructure for a scaffolding or platform or of a scaffolding or platform, or suspension for a suspended scaffolding or of a suspended scaffolding, wherein the truss frame consists of several rod-shaped individual parts of metal, particularly of steel, which can be detached again, namely at least two elongate parallel post tubes each extending in the direction of the longitudinal axis thereof and each having an outer circumference (44), at least two elongate parallel crossbars which each extend in the direction of the longitudinal axis thereof and which extend perpendicularly to the post tubes, and at least one elongate diagonal element, which is adjustable in its length by means of integrated length adjusting means and, in particular, is mounted free of play and which extends in the direction of its longitudinal axis between diagonally opposite corner regions of the truss frame, wherein each post tube of the post tubes has post tube ends, which face away from one another and to which are respectively secured two parallel connecting plates, which extend parallel to the longitudinal axes of the post tubes and parallel to the longitudinal axes of the crossbars, wherein each crossbar has crossbar ends which face away from one another and which are each pivotably and detachably secured to an associated connecting plate of the connecting plates by means of a respective bolt, wherein the at least one diagonal element has diagonal element ends, which face away from one another and which are each pivotably and detachably secured to an associated connecting plate of the connecting plates by means of a respective bolt, wherein the bolts have bolt axes which extend transversely or perpendicularly to the longitudinal axes of the post tubes and the crossbars and wherein at least two or at least three or at least four or at least five connecting elements for connection of scaffolding components and/or to scaffolding components are fixedly welded to each post tube at a mutual spacing corresponding with an integral multiple of a grid dimension of a modular scaffolding.

A truss frame of that kind has become known from, for example, DE 10 2009 021 424 A1 or the parallel EP 2 253 764 A2 of the Applicant. Several of these truss frames can be assembled to form a modular truss girder, which has in practice become known under the designation Layher Allround bridge girder. This bridge girder is over-dimensioned for, for example, span widths of approximately 13 metres to 20 metres with a traffic load of approximately 0.5 kN/m$^2$ and thus is not economic for these span widths. Cambering of the main truss is possible due to an adjustable diagonal reinforcing. A significant disadvantage of this bridge girder is that this has to be mounted outside the system dimensions of the modular scaffolding system. Moreover, the weight of the heaviest individual part of the truss frame is 56 kilograms, so that a lifting gear is required for assembly.

It is an object of the invention to make available a truss frame of the kind stated in the introduction which with advantageous length adjustment and span possibilities of its diagonal element is adjustable particularly simply and economically, offers advantageous possibilities for attachment and/or extension within the horizontal and vertical system dimensions of known modular scaffoldings, particularly of the Layher Allround modular scaffolding or for compatibility with these modular scaffoldings, and also offers advantageous possibilities for a manual capability of handling the heaviest individual part so that it is possible to avoid a hoist.

In the case of a truss frame with the features stated in the introduction this object is fulfilled in that, in particular, the connecting elements are rosettes for connection of and/or to connecting heads of scaffolding components, that the two parallel connecting plates secured in the region of each post tube end are arranged in a common notional plane containing the longitudinal axis of the respective post tube, preferably also the longitudinal axis of the respective crossbar, and extend away from one another, that a respective connecting body is fixedly welded in the region of or to at least two post tube ends, which are respectively associated with the same crossbar, of the post tubes and surrounds the outer circumference of the respective post tube around the whole circumference, preferably free of interruption, and that the two connecting plates respectively secured in the region of these post tube ends of the post tubes are fixedly welded at least either to the respective connecting body or to the respective connecting body and the respective post tube.

Due to the fact the connecting elements are rosettes for connection of and/or to connecting heads of the scaffolding components, advantageous possibilities are realised for attachment and/or extension within the horizontal and vertical system dimensions of known modular scaffoldings, particularly the Layher Allround modular scaffolding or for compatibility with these modular scaffoldings.

As a consequence of the fact that the two parallel connecting plates secured in the region of each post tube end are arranged in a common notional plane containing the longitudinal axis of the respective post tube, preferably also the longitudinal axis of the respective crossbar, and extend away from one another, that a respective connecting body is fixedly welded in the region of or to at least two post tube ends, which are respectively associated with the same crossbar, of the post tubes and encloses the outer circumference of the respective post tube over the entire circumference, preferably free of interruption or in uninterrupted manner, and that the two connecting plates respectively secured in the region of these post tube ends of the post tubes are fixedly welded at least either to the respective connecting body or to the respective connecting body and the respective post tube, the 'arriving' forces transmitted by way of the said crossbar can with particular advantage be transferred substantially to the connecting body and from this to a further connecting plate of the connecting plates and—insofar as a further crossbar is detachably secured to this further connecting plate, preferably parallel to the said crossbar of the truss frame, preferably at the same crossbar height—are transmitted to this further crossbar. Moreover, particularly due to the connecting body enclosing the outer circumference of the respective post tube over the whole circumference, preferably in uninterrupted manner or free of interruption, overloading, for example compression, of the respective post tube of the post tubes in the respective connecting region is prevented.

Through the measures according to the invention overall the weight of the heaviest individual part, namely the individual post tube, can be considerably reduced, particularly to only just 15 kilograms, so that manual assembly without a lifting gear is possible.

The post tubes are preferably round tubes or post round tubes. As a result, special accessory parts, for example special adapters or special couplings, are not needed for connecting the truss frame or main truss to an existing modular scaffolding within the system dimensions.

According to a particularly preferred variant of embodiment it can be provided that a respective rosette of the rosettes is arranged in the region or vicinity of at least those post tube ends to which the respective connecting body is fixedly welded and that in each instance a rose part of this rosette respectively projects into and through a receiving slot of each connecting plate of the two connecting plates respectively secured in the region of these post tube ends. As a result, a still further improved transmission of force in the critical connecting region and a further reduced weight can be achieved and connection possibilities in the grid dimension also arise in this region.

In that case, according to an advantageous development it can be provided that each connecting plate having the receiving slot is fixedly welded to the connecting body, to the post tube and to the rosette. A still further improved transmission of force in the critical connecting region can thereby be achieved.

For preference it can be provided that that at least two of the connecting bodies are connecting sleeves and/or that at least two of the connecting bodies are connecting rosettes or connecting discs, with or without passages. Connecting bodies of that kind can be produced or are available in particularly simple and economic manner.

According to a preferred embodiment it can be provided that each connecting sleeve of the at least two connecting sleeves is formed in such a way that a connecting head of a scaffolding component can be detachably firmly wedge-connected by means of a connecting wedge to a rosette, which is associated with the respective connecting sleeve, without collision with the connecting sleeve or in collision-free manner.

According to a particularly preferred variant of embodiment it can be provided that each connecting sleeve, which is preferably substantially circularly cylindrical, of the at least two connecting sleeves has an outer diameter which is selected so that a gap is formed between a connecting wedge, by means of which the connecting head of the scaffolding component is detachably firmly wedge-connected with the associated rosette, and an outer surface, which spans the outer diameter and is preferably substantially circularly cylindrical, of the connecting sleeve. The gap is preferably approximately 1 millimetre to 2 millimetres.

Through the aforesaid measures the compatibility of the truss frame according to the invention with known modular scaffoldings, particularly with the Layher Allround modular scaffolding, can be further improved with expanded connection possibilities for or of system-compatible scaffolding components.

According to an advantageous development it can be provided that the diagonal element comprises a length adjusting and clamping device by means of which the diagonal element can be shortened in its length so that cambering and/or biasing of the truss frame or of a truss frame or truss girder comprising the truss frame can be set. In the ready-for-use constructed state of the truss frame according to the invention the diagonal element is mounted free of play.

According to a preferred embodiment it can be provided that each rosette of the rosettes is fixedly welded to the respective post tube at a mutual spacing from the directly adjacent rosette of the rosettes, which spacing corresponds with the simple grid dimension. Compatibility with known modular scaffolding systems, particularly with the Layher Allround modular scaffolding system, is thereby further improved and additional connecting possibilities for scaffolding system components are thereby created.

According to a particularly preferred variant of embodiment it can be provided that each post tube of the post tubes has a rosette, which lies closest to the respective post tube end, of the rosettes and that at least one post tube of the post tubes is connected with a scaffolding post of a modular scaffolding by means of a preferably proprietary tube connector, wherein several rosettes are secured to the scaffolding post at a mutual spacing corresponding with the grid dimension, each rosette being of substantially the same form as the rosettes of the post tubes, and wherein the rosette, which lies closest to a scaffolding post end of the scaffolding post, of the scaffolding post has from the closest rosette of the post tube end a rosette spacing corresponding with an integral multiple of the grid dimension or with the simple grid dimension. By virtue of these measures, attachment and/or extension not only within the vertical system dimensions, but also within the horizontal system dimensions of known modular scaffoldings, particularly the Layher Allround modular scaffolding, is or are made possible to a particular extent. This is in contrast to the situation with the Layher Allround bridge girder mentioned in the introduction, in which for constructional reasons there is a lateral offset of the longitudinal axis of the vertical posts used there, to which lateral connecting heads are secured, from the longitudinal axes of the scaffolding components detachably connectible with these connecting heads by means of the connecting wedges thereof by way of their rosettes. Apart from that, if extension coaxially to the longitudinal axis of the posts of the bridge girder within the vertical system dimensions is desired a special accessory in the form of a post attachment having a rosette has to be provided thereat, separately handled and inserted into the square tube of the post of the bridge girder. This is costly.

According to a preferred embodiment it can be provided that at least one rosette of the rosettes or at least two or at least three or at least four of the rosettes has or have passage openings for the plugging-through of a connecting element of a connecting head of a scaffolding component and/or for the plugging-through of a connecting wedge for firm wedge-connection of a connecting head of a scaffolding component to a rosette of the rosettes and/or that at least one rosette of the rosettes or at least two or at least three or at least four of the rosettes is an apertured disc or are apertured discs. As a result, a particular degree of compatibility with known modular scaffoldings, particularly with the Layher Allround modular scaffolding, can be achieved.

According to a particularly preferred variant of embodiment it can be provided that the length adjusting means is a length adjusting and clamping element which has a first thread in the region of a first end or at its first end and which has a second thread in the region of its second end facing away from the first end, preferably in an opposite direction, or a second thread at its second end facing away from the first end, preferably in an opposite direction, and that the diagonal element comprises a first diagonal rod and a second diagonal rod, wherein the first diagonal rod has a second thread at its first diagonal rod end and the second diagonal rod has a first thread at its first diagonal rod end, wherein the first thread of the length adjusting and clamping element is screwed, preferably releasably, to the first thread of the second diagonal rod rotatably relative to one another about a first axis of rotation, wherein the second thread of the length adjusting and clamping element is screwed, preferably releasably, to the second thread of the first diagonal rod rotatably relative to one another about a second axis of rotation, which is preferably arranged coaxially with respect to the first axis of rotation, and that the first thread of the length adjusting and clamping element, the second thread of the length adjusting and clamping element, the first thread of the second diagonal rod and the second thread of the first diagonal rod are respective threads turning in the same direction, thus either are right-turning or righthand threads or are left-turning or lefthand threads, wherein the first thread of the length adjusting and clamping element and the first thread screwed thereto of the second diagonal rod respectively have a first pitch, thus identical first pitches, and wherein the second thread of the length adjusting and clamping element and the second thread screwed thereto of the first diagonal rod respectively have a second pitch, thus' identical second pitches, which by comparison with the first pitch are of different size. Through these measures it is possible to achieve particularly advantageous length adjusting and clamping possibilities of the diagonal element. Due to the fact that the first internal thread, the second internal thread, the first external thread and the second external thread are respective threads turning in the same direction and that the first internal thread and the first external thread each have a first pitch, whilst the second internal thread and the second external thread each have a second pitch which is of different size by comparison with the first pitch, more precise clamping possibilities are created than in the case of use of a length adjusting clamping element according to the prior art, which has a right-turning internal thread and a left-turning internal thread, the pitch of which is identical, in combination with two diagonal rods according to the prior art, which each have external threads, which turn in the same direction, respectively with the identical pitch to the internal threads of the length adjusting and clamping element according to the prior art. Length adjusting clamping elements according to the prior art, which are also termed turnbuckles, always have at the ends thereof facing away from one another threads with identical or same-size pitches, wherein always one of the threads is a righthand thread and another one of the threads is a lefthand thread. In the case of the variant of embodiment according to the invention the length adjustment and clamping are made possible by the different pitches in combination with the threads turning in the same direction. As a result, on the one hand a rapid length adjustment or clamping and on the other hand a precisely settable length adjusting or clamping can be achieved.

According to an advantageous embodiment the first thread and the second thread of the length adjusting and clamping element can each be an internal thread and the second thread of the first diagonal rod and the first thread of the second diagonal rod can each be an external thread. However, it will be obvious that the first thread and the second thread of the length adjusting and clamping element can each be an external thread and that the second thread of the first diagonal rod and the first thread of the second diagonal rod can each be an internal thread. In addition, other thread combinations are also conceivable in which the length adjusting and clamping element has not only an internal thread, but also an external thread, whilst the first thread of the second diagonal rod is an internal thread and the second thread of the first diagonal rod is an external thread or whilst the first thread of the second diagonal rod can be an external thread and the second thread of the first diagonal rod can be an internal thread.

According to a preferred development it can be provided that the first pitch is at least twice the size of the second pitch and/or that the first pitch is at least 5 millimetres or approximately 10 millimetres and that the second pitch has a size which either lies in a region of 1 millimetre to 4 millimetres or which is approximately 3 millimetres. The aforesaid advantages can thereby be achieved to a special degree.

According to a preferred embodiment it can be provided that the first thread of the length adjusting and clamping element and the first thread of the second diagonal rod are each associated with a first form of thread, thus identical first forms of thread, and that the second thread of the length adjusting and clamping element and the second thread of the first diagonal rod are each associated with a second form of thread, thus identical second forms of thread different from the first form of thread. These measures are to be contrasted with the constructions known from the prior art in which the internal thread of the length adjusting and clamping element or of the turnbuckle and the associated external thread of the diagonal rods always have identical forms of thread.

According to an advantageous development it can be provided that the first thread of the length adjusting and clamping element and the first thread of the second diagonal rod are each a Dywidag thread and that the second thread of the length adjusting and clamping element and the second thread of the first diagonal rod are each a metric thread. As a result a more precise length adjusting and clamping possibility is created than in the case of use of two diagonal rods with Dywidag external threads in combination with a length adjusting and clamping element with two matching Dywidag internal threads according to the prior art. Moreover, length adjustment and clamping is possible more quickly than with two threaded rods with metric threads.

The invention also relates to a modular truss girder which is constructed from several truss frames according to the invention arranged in a common truss plane, preferably in such a way that several mutually identical crossbars—or crossbars which in pairs per truss frame differ only in the length thereof and are otherwise mutually identical—are horizontally arranged in a row and pivotably and detachably secured by means of the associated bolts to the associated connecting plates of the associated at least three or more mutually identical post tubes respectively extending perpendicularly to the crossbars, wherein at least two or more crossbars of the crossbars form an upper chord in which the longitudinal axes of the crossbars are arranged substantially coaxially or in alignment, and wherein at least two or more crossbars of the crossbars form a lower chord in which the longitudinal axes of the crossbars are arranged substantially coaxially or in alignment.

The invention also relates to a bridging and/or support construction, for example a pedestrian bridge, a catwalk, a platform or a scaffolding or an underpinning for a scaffolding or of a scaffolding, a substructure for a scaffolding or platform or of a scaffolding or platform, or a suspension for a suspended scaffolding or of a suspended scaffolding, with at least one or more truss frames according to the invention, or with a truss girder according to the invention.

It will be obvious that the aforesaid features and measures can be combined as desired within the scope of feasibility.

Further features, advantages and aspects of the invention are evident from the claims and from the following description part, in which a preferred embodiment of the invention is described by way of the figures, in which:

FIG. 2 shows the truss frame according to FIG. 1 in a plan view;

FIG. 4 shows the truss frame according to FIG. 2 in a top view;

Figure 1:
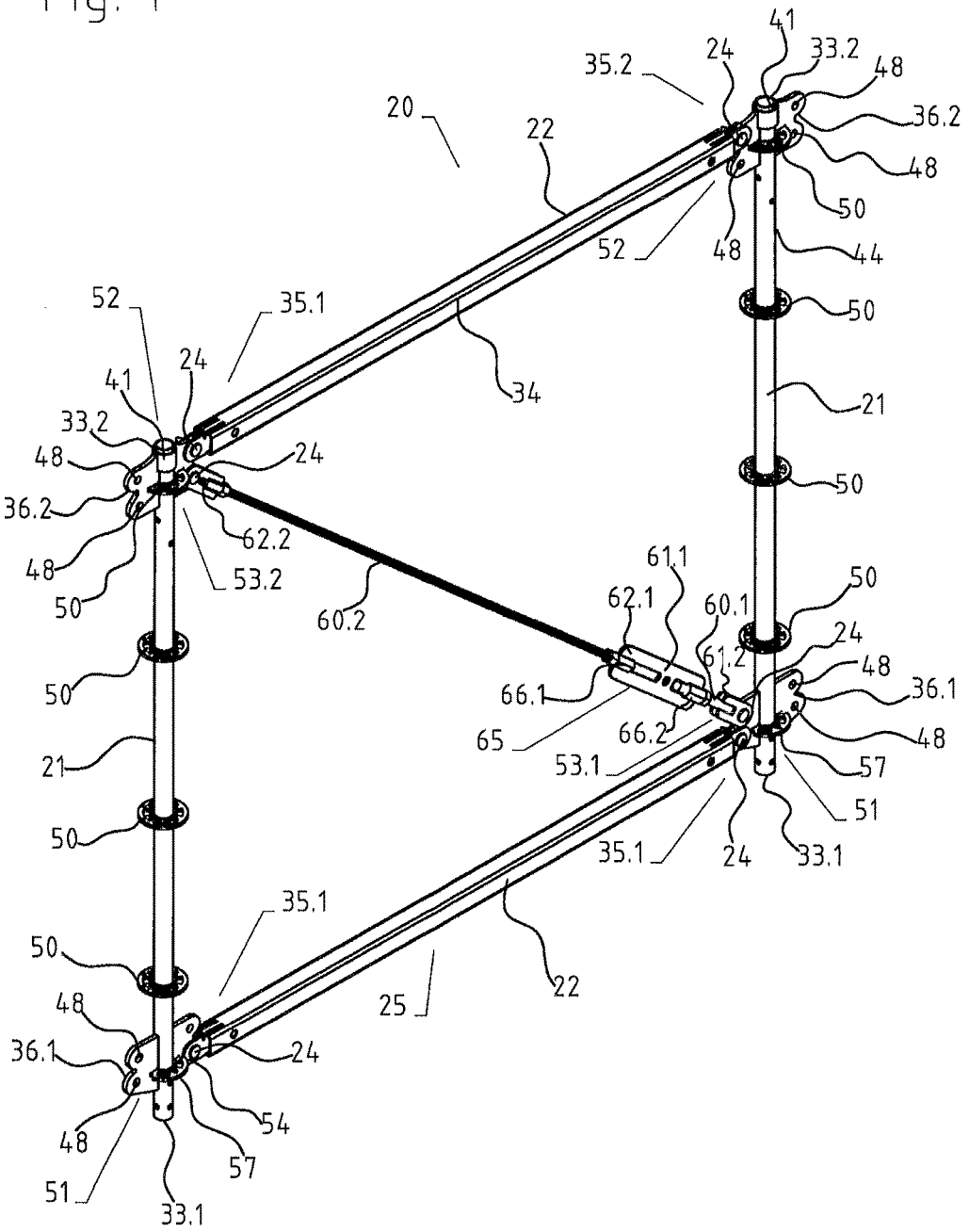
FIG. 1 shows a three-dimensional view of a truss frame according to the invention.

The truss frame 20 according to the invention is assembled from a plurality of rod-shaped individual parts of steel so as to be separable again. Significant individual parts are two identical elongate post tubes 21, two identical elongate crossbars 22 and at least one elongate diagonal element 23, which is adjustable in length. The two post tubes 21 and the two crossbars 22 as well as the at least one diagonal element 23 are pivotably and detachably connected together by way of bolts 24. The two post tubes 21 are arranged to be substantially parallel to one another. The two crossbars 22 are similarly arranged substantially parallel to one another. The crossbars 22 are arranged substantially perpendicularly to the post tubes 21. The post tubes 21 and crossbars 22 are connected to form a frame 25. The longitudinal axes 26 of the post tubes 21 and the longitudinal axes 27 of the crossbars 22 span a truss plane 28. The bolt axes 29 of the bolts 24 are arranged perpendicularly to the longitudinal axes 26 of the post tubes 21 and perpendicularly to the longitudinal axes 27 of the crossbars 22 or perpendicularly to the said truss plane 28. The post tubes 21 and the crossbars 22 are connected or tightened by means of the at least one diagonal element 23 to form a stable truss frame 20. In that case the at least one diagonal element 23 is installed or tightened free of play.

The truss frame 20 serves for construction of a bridging and/or support construction, which is not shown in the figures. The truss frame 20 is incorporated therein according to intention in such a way that the post tubes 21 are arranged vertically or perpendicularly. The crossbars 22, which are horizontal in the attached or installed state, form chords of the truss frame 20. In the attached or installed state the lower or first crossbar 22 forms a lower chord or a component of a lower chord, whilst the upper or second crossbar 22 forms an upper chord or a component of an upper chord.

Each post tube 21 has a length 30 of preferably 2,000 millimetres. Each post tube 21 extends substantially rectilinearly along its longitudinal axis 26. The longitudinal axis 26 of the first post tube 21 shown each time on the left in FIGS. 1 to 4 has a spacing 31 from the longitudinal axis 26 of the second post tube 21 shown each time on the right in FIGS. 1 to 4. This spacing 31 corresponds with a system spacing of a modular scaffolding system. For preference, the said spacing 31 is a system spacing of the Layer Allround modular scaffolding system. For example, the said spacing 31 is approximately 2,070 millimetres.

Each crossbar 22 extends substantially rectilinearly along its longitudinal axis 27. The longitudinal axis 27 of the first crossbar 22 shown each time at the bottom in FIGS. 1 to 4 has a spacing 32 from the longitudinal axis 27 of the second crossbar 22 shown each time at the top in FIGS. 1 to 4. This spacing 32 is preferably approximately 1,800 millimetres.

For preference, the post tubes 21 are round tubes or post round tubes. The post tubes 21 preferably each have an outer diameter 43 of 48.3 millimetres and a wall thickness of approximately 3.2 millimetres or of approximately 4.0 millimetres. The post tubes 21 preferably consist of steel of the quality S355. Each post tube 21 has a first post tube end 33.1, which in each instance is lower in FIGS. 1 to 3, and a second post tube end 33.2 which faces away therefrom and in each instance is upper in FIGS. 1 to 3.

The crossbars 22 are formed by square or four-cornered tubes 34. These have a thickness or width or an outer diameter of preferably 60 millimetres and a wall thickness of preferably 4 millimetres. Each crossbar 22 has a first crossbar end 35.1, which is shown each time on the left in FIGS. 1, 2 and 4, and a second crossbar end 35.2, which faces away therefrom and is shown each time on the right in FIGS. 1, 2 and 4.

Two connecting plates 36.1, 36.2 of steel are secured in the region of each post tube end 33.1, 33.2 of the post tube 21. In that case these are connecting, coupling or junction plates. The two first or lower connecting plates 36.1 associated with the first or lower post tube end 33.1 of the first or lefthand post tube 21 and the two first or lower connecting plates 36.1 associated with the first or lower post tube end 36.1 of the second or righthand post tube 21 are of the same form. In addition, the two second or upper connecting plates 36.2 associated with the second or upper first tube end 33.2 of the first or lefthand post tube 21 and the two second or upper connecting plates 36.2 associated with the second or upper post tube end 33.2 of the second or righthand post tube 21 are of the same form.

Each two connecting plates 36.1; 36.2 of the four connecting plates 36.1; 36.2 of each post tube 21 are arranged in pairs at the same height and respectively form a connecting plate pair 37.1; 37.2. The two connecting plates 36.1; 36.2 of each connecting plate pair 37.1; 37.2 of each post tube 21 are arranged parallel to one another in a notional common plane 38 containing the longitudinal axis 26 of the respective post tube 21. The two connecting plates 36.1; 36.2 of each connecting plate pair 37.1; 37.2 of each post tube 21 extend away from one another in opposite directions. Each connecting plate 36.1; 36.2 of the connecting plates 36.1; 36.2 has an outer profile of butterfly-wing shape. Each connecting plate 36.1; 36.2 has two connecting straps 39.1, 40.1; 39.2, 40.2. Each connecting strap 39.1, 40.1; 39.2, 40.2 has a passage opening 48 for a bolt 24.

A respective connecting sleeve 41, which is also termed connecting body, is secured to the second or upper post tube ends 33.2, which face in the same direction, of the post tubes 21. Each connecting sleeve 41 is a round tube of steel or a section of a round tube of steel. Each connecting sleeve 41 has a substantially circularly cylindrical inner circumferential surface and a substantially circularly cylindrical outer circumferential surface 42. Each connecting sleeve has an inner diameter which is slightly larger than the respective outer diameter 43 of the respective post tube 21. Each connecting sleeve 41 has an outer diameter 45 of preferably approximately 60.3 millimetres. Each connecting sleeve 41 surrounds the outer circumference 44 of the respective post tube 21 completely and in uninterrupted manner. Each connecting sleeve 41 is fixedly welded at the sleeve ends thereof facing away from one another to the post tube 21 inserted therein.

The second or upper connecting plates 36.2 associated with the respective connecting sleeve each have a receiving slot 47. The latter is open towards the side, which faces the respective post tube 21, of the respective second or upper connecting plate 36.2. The said receiving slot 47 as considered in the direction of the longitudinal axis 26 of the respective post tube 21 is disposed between the respective two connecting straps 39.1, 40.1 of the respective second or upper connecting plate 36.2 or between the passage openings 8 of the respective two connecting straps 39.1, 40.1 of the respective second or upper connecting plate 36.2.

The respective two second or upper connecting plates 36.2 of each post tube 21 are each plugged by the receiving slot 47 thereof onto an apertured disc 50, which is also termed rosette. The latter is fixedly welded, in each instance in the region of the second or upper post tube end 33.2—which is provided with the connecting sleeve 41—of the respective post tube 21, to this. The respective two second or upper connecting plates 36.2 are fixedly welded not only to the respective connecting sleeve 41, but also to the respective post tube 21, as well as to the respective associated apertured disc 50. The respective two second or upper connecting plates 36.2, the associated connecting sleeve 41 and the associated apertured disc 50 each form a second or upper connecting unit 52.

Each apertured disc 50 of each post tube 21 is formed in a manner known per se with parallel side surfaces which have a mutual spacing corresponding with the apertured disc thickness and amounting to, preferably, 9 millimetres to 10 millimetres. Each apertured disc 50 of each post tube 21 has, in a manner known per se, eight passage openings which are respectively arranged to be offset relative to one another at a circumferential angle of 45 degrees. In that case, four small passage openings and four large passage openings are provided similarly in a manner known per se and are respectively arranged in alternation so that as considered in circumferential direction a large passage opening is arranged each time between two small passage openings and a small passage opening is arranged each time between two large passage openings.

The apertured discs 50 arranged in the region of the connecting sleeves 41 and the slotted second or upper connecting plates 36.2 arranged thereat are respectively fixedly welded to the respective post tube 21 and welded to the respective slotted second or upper connecting plate 36.2 in such a way that six of their eight passage openings remain free, wherein, referred to each of the two connecting plate sides—which face away from one another—of the respective slotted second or upper connecting plate 36.2, in each instance three passage openings remain free. Moreover, these apertured discs 50 are so arranged that in each instance two small passage openings of the total of four small passage openings are covered by the preferably parallel slot walls, which bound the receiving slot 47 of the respective second or upper connecting plate 36.2, of the second or upper connecting plate 36 concerned. The four large passage openings and two of the four small passage openings thus remain free.

A respective crossbar 22 of the two crossbars 22 is respectively connected, to be separable again, by means of a bolt 24 to the respective crossbar connecting straps 39.1, 39.2, which are arranged oppositely in pairs at the same height and extend towards one another, of the connecting plates 36.1; 36.2 of the two post tubes 21, the bolt being plugged through the respective passage opening 48 of the respective crossbar connecting strap 39.1; 39.2. Each bolt 24 extends by the bolt longitudinal axis 29 thereof perpendicularly to the longitudinal axes 26, 27 of the post tube 21 and the crossbar 22 and thus perpendicularly to the said truss plane 28.

In diagonally opposite corner regions, for example in the corner regions 53.1, 53.2 of the truss frame 20 shown at the top left and bottom right in FIGS. 1 and 2, the diagonal element 23 is similarly connected by way of bolts 24, so as to be detachable again, to diagonally opposite diagonal-element connecting straps 40.1, 40.2, which extend towards one another, not only of a second or upper connecting plate 36.2 of the second or upper connecting plates 36.2, for example of the first or lefthand post tube 21, but also to a first or lower connecting plate 36.1 of the first or lower connecting plates 36.1, for example of the second or right-hand post tube 21. Each of these bolts 24 extends by the bolt longitudinal axis 29 thereof perpendicularly to the longitudinal axes 49, 26, 27 of the diagonal element 23, the post tube 21 and the crossbar 22 through in each instance a passage opening 48 of the respective diagonal connecting strap 40.1, 40.2.

Each crossbar 22 comprises a straight, square or four-cornered tube 34 extending substantially over the entire length of the crossbar. A respective connecting connector 54 is inserted into each of the tube ends, which face away from one another, of the respective square or four-cornered tube 34 and secured thereat, preferably by welding. Each connecting connector 54 comprises two connecting straps. The respective two connecting straps are arranged parallel to one another at a mutual spacing. The spacing is slightly larger than the wall thickness of the respectively associated connecting plate 36.1, 36.2. Each connecting strap of the connecting connector 54 has a passage opening for a bolt 24. In the mounted state, each crossbar 22 is plugged by its connecting straps, which are arranged at both ends, respectively onto a crossbar connecting strap 39.1, 39.2 of a connecting plate 36.1, 36.2 of the connecting plates of a post tube 21 of the post tubes 21. In that case, the passage openings of the respective two connecting straps of the respective connecting connector 54 of the crossbar 22 concerned are aligned with the passage opening 48 of the respective crossbar connecting strap 39.1, 39.2 of the respective connecting plate 36.1, 36.2, wherein in each instance one of the bolts 24 of the bolts 24 is plugged through the respective three passage openings.

Figure 3:
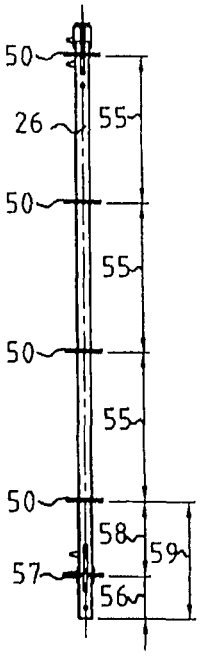
FIG. 3 shows the truss frame according to an embodiment in a side view from the left.

Apart from the afore-mentioned apertured disc 50 uppermost in each of FIGS. 1, 2 and 3, which is partly received in the receiving slot 47 of the slotted second or upper connecting plate 36.2, additionally also three further identical apertured discs 50 are fixedly welded to each post tube 21. All apertured discs 50 of each post tube 21 are, as considered in the direction of the longitudinal axis 26 of the respective post tube 21, respectively arranged at a mutual spacing 55 corresponding with the simple grid dimension of a modular scaffolding or of a modular scaffolding system, particularly of the Layher Allround modular scaffolding or modular scaffolding system. This spacing 55 is preferably approximately 500 millimetres. At each post tube 21 that apertured disc 50 of the apertured discs 50 which has the greatest spacing from the second or upper post tube end 33.2 or which is associated with the first or lower post tube end 33.1 has a spacing 59 from an end edge, which is formed at the respective first or lower post tube end 33.1, of the respective post tube 21. This spacing 59 is preferably approximately 400 millimetres. Each apertured disc 50 has an outer diameter of, for preference, approximately 123.5 millimetres. Each apertured disc has an apertured disc thickness of preferably approximately 9 millimetres or approximately 10 millimetres.

A connecting disc 57, which is also termed connecting body, of solid material is fixedly welded to each post tube 21 at a spacing 56, which is preferably approximately 145 millimetres to 155 millimetres, from the end edge, which is formed at the respective first or lower post tube end 33.1, of the respective post tube 21. Each connecting disc 57 has an outer diameter of preferably approximately 100 millimetres. Each connecting disc 57 has a disc thickness preferably corresponding with the apertured disc thickness of the apertured discs 50. The disc thickness is preferably approximately 9 millimetres or approximately 10 millimetres. Each connecting disc 57 has, as considered in the direction of the longitudinal axis 26 of the respective post tube 21, a spacing 58 from the closest apertured disc 50. This spacing 58 is preferably approximately 245 millimetres. The function of the respective connecting disc 57 substantially corresponds with the function of the respective connecting sleeve 51. Accordingly, also conceivable, instead of the respective connecting disc 57, would be a—preferably identical—connecting sleeve such as is provided at the opposite, second or upper post tube end 33.2 of the post tube 21.

Each connecting disc 57 is partly received in a receiving slot 46, which is open towards the respective post tube 21, of a connecting plate 36.1 of the respective first or lower connecting plates 36.1. Each first or lower connecting plate 36.1 is welded not only to the respective post tube 21, but also to the respective connecting disc 57. Each connecting disc 57 forms together with the respective associated two first or lower connecting plates 36.1 a first or lower connecting unit 51.

By contrast in each instance to the position of that apertured disc 50 which is associated with the second or upper connecting unit 52 comprising a connecting sleeve 41, each connecting disc 57 is arranged at the height of the crossbar connecting strap 39.1 of the respective first or lower connecting plate 36.1. This is preferably such that the respective horizontal centre plane of the connecting disc 57 and the bore axis of the respective crossbar connecting strap lie in a notional common plane. This has the consequence that the longitudinal axis 27 of the first or lower crossbar 22 is approximately aligned with the respective horizontal centre plane of the respective connecting disc 57. As a result, the forces 'arriving' by way of the first or lower crossbar 22 can be optimally transferred to the respective connecting disc 57.

The diagonal element 23 comprises two diagonal rods 60.1, 60.2, namely a straight first diagonal rod 60.1 and a straight second diagonal rod 60.2. The diagonal rods 60.1, 60.2 are respectively Dywidag rods or tightening rods having a Dywidag external thread. Each diagonal rod 60.1, 60.2 has a first diagonal rod end 61.1; 61.2 and a second diagonal rod end 61.2; 62.2 facing away therefrom in an opposite direction. The first diagonal rod 60.1, which is shown at the bottom right in each of FIGS. 1 and 2, has a first diagonal rod length and the second diagonal rod 60.2 shown on the left in each of FIGS. 1 and 2 has a second diagonal rod length. The second diagonal rod length is preferably smaller than the first diagonal rod length or conversely.

Each diagonal rod 601, 60.2 is secured by a first diagonal rod end 61.1; 62.1 of its two diagonal rod ends 61.1, 61.2; 62.1, 62.2 to a length adjusting and clamping element 65, which is also termed length adjusting means or turnbuckle. By means of the length adjusting and clamping element 65 the diagonal element 23 can be adjusted in its length and tightened to the frame 25, which is formed from the two post tubes 21 and the two crossbars 22, to form the stable truss frame 20. The length adjusting and clamping element 65 has at each of its ends 66.1, 66.2 facing away from one another an internal thread 63.1, 63.2 into each of which the external thread 64.1, 64.2 of the associated diagonal rod end 61.1; 62.1 of the respective diagonal rod 60.1, 60.2 is screwed. The thread flights of the external thread 64.1, 64.2 of the diagonal rods 60.1, 60.2 and the thread flights of the internal threads 63.1, 63.2 of the length adjusting and clamping element 65 are formed to be matched to one another in such a way that on rotation of the length adjusting and clamping element 65 about its longitudinal axis 78 in a first direction of rotation the two diagonal rods 60,1, 60.2 are moved towards one another and that on rotation of the length adjusting and clamping element 65 in a second direction of rotation opposite to the first direction of rotation the two diagonal rods 60.1, 60.2 are moved away from one another in opposite directions.

Each diagonal rod 60.1, 60.2 has at its second diagonal rod end 61.2; 62.2 facing away from its first diagonal rod end 61.1; 62.2 a securing body 67 connected with the respective diagonal rod 60.1, 60.2 thereat to be secure against relative rotation. Each securing body 67 has two connecting straps which extend at a spacing parallel to one another away from the respective diagonal rod 60.1, 60.2. Each connecting strap of these connecting straps has a passage opening for a bolt 24. In the state of being mounted at the respectively associated diagonal connecting strap 40.1, 40.2 of the respective connecting plate 36.1, 36.2 of the respective post tube 21 the passage openings of the said connecting straps of the respective diagonal rod 60.1, 60.2 are aligned with the respective passage opening 48 of the respective diagonal connecting strap 61.1; 61.2, wherein a respective bolt 24 of the bolts 24 is plugged through each of the three passage openings aligned with one another.

The passage openings for the bolts 24 are circularly cylindrical passage openings. The bolts 24 are circularly cylindrical bolts.

The truss frame 20 according to the invention can be assembled together preferably as follows: Initially, a frame 25 is constructed from the two post tubes 21 and from the two crossbars 22. The diagonal element 23 is subsequently installed in the frame 25. Subsequently thereto the length adjusting and clamping element 65 is rotated in the said first rotational direction about the longitudinal axis 78 thereof until through the thereby-produced movement towards one another of the two diagonal rods 60.1, 60.2 with simultaneous shortening of the length of the diagonal element 23 the post tubes 21 and crossbars 22, which form the said frame 25, are connected or tightened together free of play. In the finally assembled truss frame 20 the post tubes 21 and the crossbars 22 are thus connected or tightened together free of play by way of the diagonal element 23. Through the tightening it is possible to achieve a desired cambering of a main truss or truss girder formed from at least one truss frame 20 according to the invention and further identical or similar crossbars, which are detachably connected therein by means of corresponding bolts, as well as at least one further identical or similar post tube connected therewith and also at least one further or similar diagonal element arranged in the same or similar manner between a post tube of the post tubes of the truss frame 20 according to the invention and the adjacent further post tube.

A connecting head 70 of a scaffolding component 71 can be detachably connected and wedge-connected in a manner known per se with each apertured disc 50 of the apertured discs 50 of the post tubes 21 by means of a connecting wedge 72. In order to make this possible even at those apertured discs 50 which are arranged in the region of the respective second or upper post tube end 33.2 of the post tubes 21, to the post tube ends 33.2 of which the respective connecting sleeve 41 is fastened, each connecting sleeve 41 has an outer diameter 45 which is so selected that a—in particular, known—connecting head 70 of a or the modular scaffolding system, particularly the Layher Allround modular scaffolding system, can be firmly wedge-connected by means of a connecting wedge 72 with the apertured disc 50, which is associated with the connecting sleeve 41, without collision with the connecting sleeve 41. For this purpose, the outer diameter 45 of the connecting sleeve 41 is selected to be smaller than the smallest spacing between an inner, front vertical wedge support surface 74 of an upper head part 73 of the connecting head 70 and an outer, front vertical support surface 74 of the upper head part 73 of the connecting head 70, by which this is supported on the outer surface of the post tube 21 in the state of firm wedge connection by means of which the connecting wedge 72. A vertical gap 76 is thereby formed between the front vertical wedge support surface 75 of the connecting wedge 72 and the outer circumference of the connecting sleeve 41, which is opposite the wedge support surface 75, in the firmly wedge-connected state. In the case of an outer diameter 45 of the connecting sleeve 41 of 60.3 millimetres the gap 76 is approximately 2.1 millimetres. In other words, the outer diameter 45 of each connecting sleeve 41 of the at least two connecting sleeves 41 is selected in such a way that a gap 76 is formed between the connecting wedge 72, by means of which the connecting head 70 of the scaffolding component 71 is detachably and firmly wedge-connected with the associated apertured disc 50, and the outer surface, which spans the outer diameter 45, of the connecting sleeve 41. The apertured discs 50 are also termed connecting elements.

Figure 6:
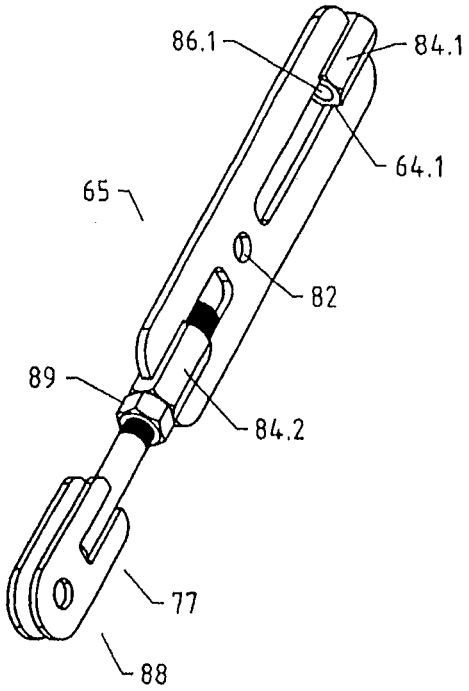
FIG. 6 shows a three-dimensional view of a preferred embodiment of a turnbuckle together with an end fitting.
Figure 5:
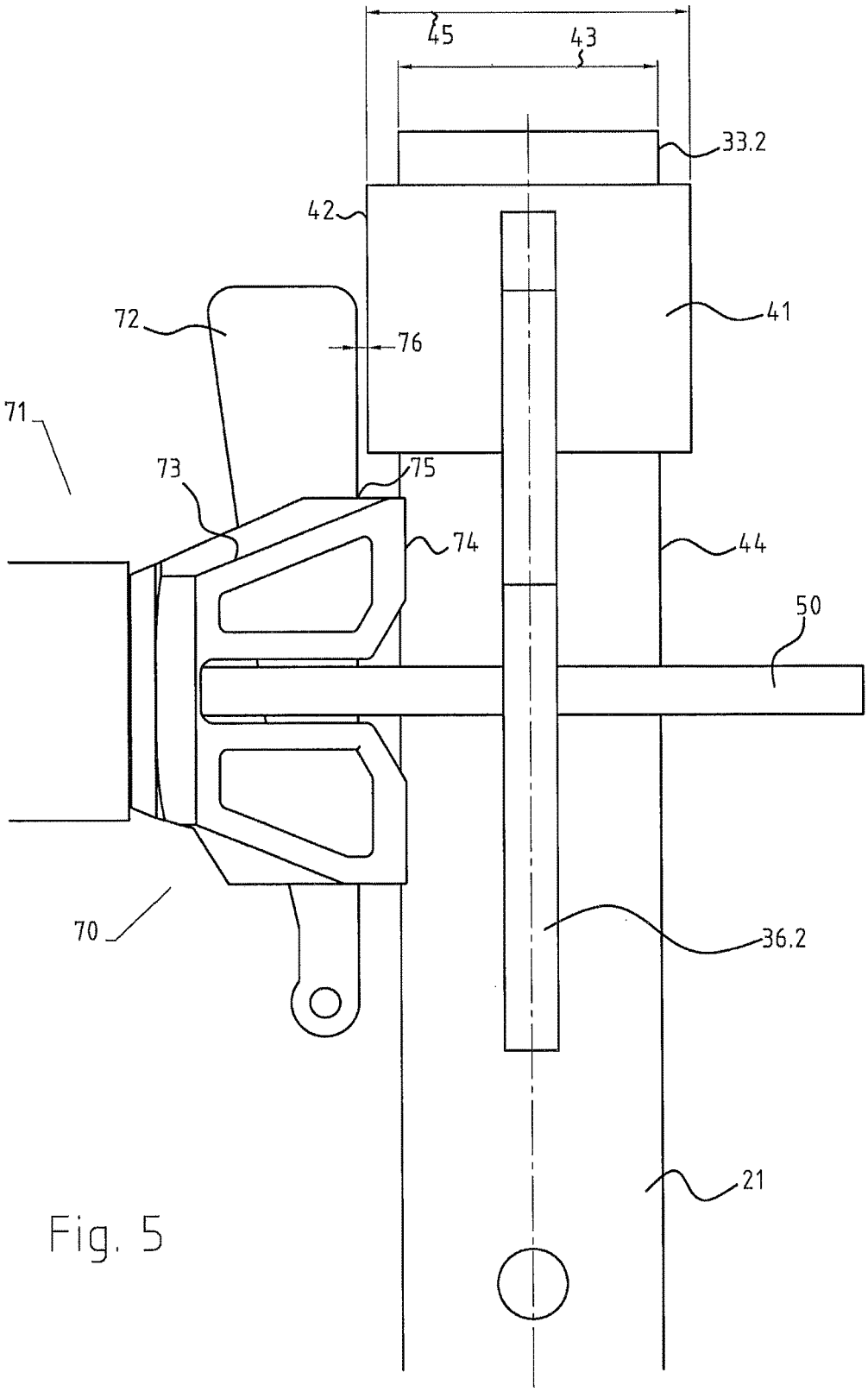
FIG. 5 shows a detail, to substantially enlarged scale, in the region of the upper connecting unit of the truss frame in a view according to FIG. 3, wherein a connecting head of a scaffolding component is wedge-connected with an apertured disc of the connecting unit by a connecting wedge disposed in the locking setting thereof.
Figure 7:
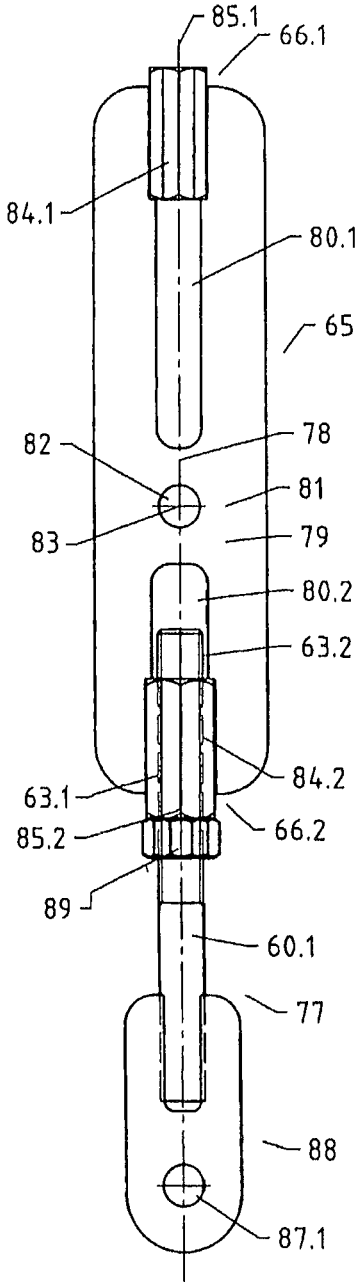
FIG. 7 shows the turnbuckle with end fitting according to FIG. 6 in a plan view.
Figure 8:
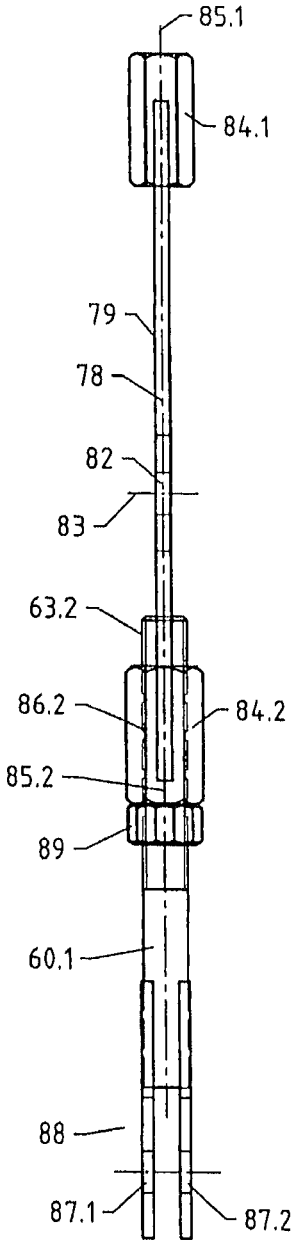
FIG. 8 shows the turnbuckle with end fitting according to FIG. 6 in a side view.

A preferred embodiment of a turnbuckle 65, which is also termed length adjusting means or length adjusting clamping element, together with an end fitting 77 detachably secured thereto is shown in FIGS. 6 to 8. The turnbuckle 65 comprises an actuating plate 79 extending along a longitudinal axis 78. The actuating plate 79 consists of—preferably galvanized—steel. The actuating plate 79 has, as considered in the direction of the longitudinal axis 78 thereof, two ends 66.1, 66.2, namely a first end 66.1 and a second end 66.2 extending away therefrom in an opposite direction. The actuating plate 79 is provided with two slots 80.1, 80.2 extending in the direction of the longitudinal axis 78 thereof, namely a first slot 80.1 and a second slot 80.2, which are respectively open towards the two sides of the actuating plate 79. As considered in the direction of the longitudinal axis 78 of the actuating plate 79 towards one another the first slot 80.1 and the second slot 80.2 are bounded by wall parts of a connecting member 81 of the actuating plate 79. The connecting member 81 is provided with a passage bore 82, the bore axis 83 of which is arranged perpendicularly to the longitudinal axis 78 of the actuating plate 79 and intersects the longitudinal axis 78. The passage bore 84 serves for the plugging-through of an actuating element (not shown in the figures), for example an actuating rod, by means of which tightening of the first diagonal rod 60.1 and the second diagonal rod 60.2 of the diagonal element 23 relative to one another can be achieved (cf. FIGS. 1 and 2).

A first elongate nut 84.1 penetrating the first slot 80.1 is arranged at, the first end 66.1 of the actuating plate 79 and a second elongate nut 84.2 penetrating the second slot 80.2 is arranged at the second end 66.2. The first elongate nut 84.1 and the second elongate nut 84.2 are fixedly welded to the actuating plate 79. The first elongate nut 84.1 has a first internally threaded bore 86.1 extending along its first nut longitudinal axis 85.1 parallel to the longitudinal axis 78 of the actuating plate 79. The second elongate nut 84.2 has a second internally threaded bore 86.2 extending along its second nut longitudinal axis 85.2 parallel to the longitudinal axis 78 of the actuating plate 79. The first internally threaded bore 86.1 of the first elongate nut 84.1 has a first internal thread 63.1. The second internally threaded bore 86.2 of the second elongate nut 84.2 has a second internal thread 63.2. The first internal thread 63.1 and the second internal thread 63.2 are respective threads turning in the same direction. The first internal thread 63.1 and the second internal thread 63.2 are preferably each a right-turning thread, which is also termed righthand thread. The first internal thread 63.1 differs from the second internal thread 63.2 not only with respect to its form of thread, but also with respect to its pitch. In the preferred embodiment shown in FIGS. 6 to 8 the first internal thread 63.1 is a Dywidag thread having a first pitch of 10 millimetres, whilst the second internal thread 63.2 is a metric thread having a second pitch of 3 millimetres.

A mating second external thread 64.2 of a first diagonal rod 60.1 is releasably screwed into the second internal thread 63.2 of the second elongate nut 84.2 of the turnbuckle 65.

This second external thread 64.2 is a righthand thread in the form of a metric thread with a pitch of 3 millimetres. The first diagonal rod 60.1 is a component of the end fitting 77. The end fitting 77 comprises a connecting element 88, which is provided with passage bores 87.1, 87.2 for the plugging-through of a bolt 24, for fastening the end fitting 77 by means of a bolt 24 to one of the connecting plates 36.1 to 36.4. In correspondence with the embodiment shown in FIGS. 1 and 2, it can be, for example, the first connecting plate 36.1 shown there each time at the bottom right.

A nut 89 can be screwed onto the second external thread 64.2 of the first diagonal rod 60.1, as shown in FIGS. 6 to 8, in a region between the second elongate nut 84.2 and the connecting element 88 of the end fitting 77. This nut 89 can, as shown in FIGS. 6 to 8, be tightened against a second elongate nut 84.2 preferably after the length adjustment or after the tightening of the diagonal element 23 with the help of the turnbuckle 65, by turning the nut 89 preferably in clockwise sense, so that the nut 89 can function as a lock nut.

A mating first external thread 64.1 of a second diagonal rod 60.2 can be releasably screwed into the first internal thread 63.1 of the first elongate nut 84.1 of the turnbuckle 65 as shown in FIGS. 1 and 2. The first external thread 64.1 of the second diagonal rod 60.2 is a righthand thread in the form of a Dywidag thread with a pitch of 10 millimetres.

Through the design and construction of the turnbuckle 65 in accordance with the invention there is created a more precise clamping possibility than with a turnbuckle in which two internal threads rotating in opposite directions or a lefthand thread and a righthand thread are provided with identical pitches. In another consideration, in the case of the turnbuckle 65 tightening is possible more rapidly than with a turnbuckle which has two internal threads respectively with an identical form of thread, for example metric threads, with identical pitches, for example of 3 millimetres.

In the turnbuckle 65 the length adjustment or the tightening can be or is realised by threads turning in the same direction and having different pitches.

It will obvious that instead of the preferred turnbuckle 65 shown in the figures, use can alternatively be made of a length adjusting and clamping element which has at one end of its ends a righthand thread and at its other end a lefthand thread, or conversely, whilst the two diagonal rods have either a righthand thread or a lefthand thread.

The invention can also be summarised as follows: Truss frame 20 for construction of a bridging and/or support construction consisting of several rod-shaped individual parts of metal, namely of two elongate parallel post tubes 21, which respectively extend in the direction of the longitudinal axis 26 thereof and which each have an outer circumference 44, two parallel crossbars 22 extending perpendicularly thereto respectively in the direction of the longitudinal axis thereof, and at least one elongate diagonal element adjustable in its length, which are pivotably connected together by way of bolts 24 to be separable again. Secured in the region of each post tube end 33.1, 33.2 of the post tubes 21 are, respectively, two parallel connecting plates 36.1, 36.2 which are arranged in a common notional plane 38 containing the longitudinal axes 26, 27 of the post tubes 21 and the crossbars 22 and which extend away from one another. Each crossbar 22 has crossbar ends 35.1, 35.2, which face away from one another and which are each pivotably and detachably secured to a connecting plate 36.1, 36.2 of the connecting plates 36.1, 36.2 by means of a respective bolt 24. The diagonal element 23 has diagonal element ends 61.2, 62.2, which face away from one another and which are each pivotably and detachably secured to a connecting plate 36.1, 36.2 of the connecting plates 36.1, 36.2 by means of a respective bolt 24. At least two rosettes 50 are fixedly welded to each post tube 21 at a mutual spacing 55 corresponding with an integral multiple of a grid dimension of a modular scaffolding. A respective connecting body 41, 57 is fixedly welded in the region of at least two post tube ends 33.1, 33.2, which are associated with the same crossbar 22, of the post tubes 21 and in each instance surrounds the outer circumference 44 of the respective post tube 21 over the whole circumference. The two connecting plates 36.1, 36.2 respectively secured in the region of these post tube ends 33.1, 33.2 are fixedly welded at least to the respective connecting body 41, 57.

REFERENCE NUMERAL LIST

20 truss frame
21 post tube/post round tube
22 crossbar
23 diagonal element
24 bolt
5 frame
26 longitudinal axis of 21
27 longitudinal axis of 22
28 truss plane/plane
29 bolt axis/bolt longitudinal axis of 24
30 length of 21
31 spacing
32 spacing
33.1 (first, lower) post tube end
33.2 (second, upper) post tube end
34 square tube/four-cornered tube
35.1 (first) crossbar end
35.2 (second) crossbar end
36.1 (first/lower) connecting plate
36.2 (second/upper) connecting plate
37.1 (first/lower) connecting plate pair
37.2 (second/upper) connecting plate pair
38 plane
39.1 (first/lower) (crossbar) connecting strap
39.2 (second/upper) (crossbar) connecting strap
40.1 (first/lower) (diagonal-element) connecting strap
40.2 (second/upper) (diagonal-element) connecting strap
41 connecting body/connecting sleeve
42 outer circumferential surface of 41
43 outer diameter of 21
44 outer circumference of 21
45 outer diameter of 41
46 receiving slot of 36.1
47 receiving slot of 36.2
48 passage opening/passage bore
49 longitudinal axis of 23
50 connecting element/rosette/apertured disc
51 (first/lower) connecting unit
52 (second/upper) connecting unit
53.1 (first/lower) corner region
53.2 (second/upper) corner region
54 connecting connector
55 spacing/grid dimension
56 spacing
57 connecting body/connecting disc
58 spacing
59 spacing
60.1 (first/lower) diagonal rod
60.2 (second/upper) diagonal rod
61.1 (first/upper) diagonal rod end of 60.1
61.2 (second/lower) diagonal rod end of 60.1/(first/lower) diagonal element end of 23
62.1 (first/lower) diagonal rod end of 60.2
6.2 (second/upper) diagonal rod end of 60.2/(second/upper) diagonal element end of 23
63.1 (first) thread/internal thread
63.2 (first) thread/internal thread
64.1 (second) thread/external thread
64.2 (second) thread/external thread
65 length adjusting means/length adjusting and clamping element/turnbuckle
66.1 (first/upper) end of 65
66.2 (second/lower) end of 65
67 securing body
70 connecting head
71 scaffolding component
72 connecting wedge
73 (upper) head part of 70
74 (vertical) support surface of 73
75 (front/vertical) wedge support surface of 72
76 (vertical) gap
77 end fitting
78 longitudinal axis/axis of rotation of 65
79 actuating plate
80.1 (first) slot
80.2 (second) slot
81 connecting member
82 passage bore
83 bore axis of 82
84.1 (first) elongate nut
84.2 (second) elongate nut
85.1 (first) nut longitudinal axis/axis of rotation
85.2 (second) nut longitudinal axis/axis of rotation
86.1 (first) threaded bore/internally threaded bore
86.2 (second) threaded bore/internally threaded bore
871 passage bore

87.2 passage bore
88 connecting element
89 nut

The invention claimed is:

1. A truss frame comprising:

(a) elongate parallel first and second post tubes of metal extending in a direction of first and second post tube longitudinal axes, respectively, the first post tube having a first outer circumference and the second post tube having a second outer circumference;

(b) elongate parallel first and second crossbars of metal extending in a direction of first and second crossbar longitudinal axes, respectively, wherein the first and second crossbars extend perpendicularly to the first and second post tubes; and (c) at least one elongate diagonal element of metal having an integrated length adjuster and an adjustable length, the adjustable length being changeable by the integrated length adjuster, the at least one elongate diagonal element extending in a direction of a diagonal element longitudinal axis between a first corner region of the truss frame and a second corner region of the truss frame diagonally opposite to the first corner region;

wherein the first post tube has a first first post tube end and a second first post tube end facing away from one another, has a first first connecting plate and a parallel second first connecting plate both secured to the first first post tube end, and has a first second connecting plate and a parallel second second connecting plate both secured to the second first post tube end;

wherein the second post tube has a first second post tube end and a second second post tube end facing away from one another, has a first third connecting plate and a parallel second third connecting plate both secured to the first second post tube end, and has a first fourth connecting plate and a parallel second fourth connecting plate both secured to the second second post tube end;

wherein the first first connecting plate, the second first connecting plate, the first second connecting plate, the second second connecting plate, the first third connecting plate, the second third connecting plate, the first fourth connecting plate, and the second fourth connecting plate extend parallel to the first and second post tube longitudinal axes and parallel to the first and second crossbar longitudinal axes;

wherein the first crossbar has a first first crossbar end and a second first cross bar end facing away from one another, wherein the first first crossbar end is pivotably and detachably secured to the first first connecting plate by a first bolt, wherein the second first crossbar end is pivotably and detachably secured to the first third connecting plate by a second bolt, wherein the second crossbar has a first second crossbar end and a second second crossbar end facing away from one another, wherein the first second crossbar end is pivotably and detachably secured to the first second connecting plate by a third bolt, wherein the second second crossbar end is pivotably and detachably secured to the first fourth connecting plate by a fourth bolt;

wherein the at least one elongate diagonal element has diagonal element ends facing away from one another and secured pivotably and detachably to the first first connecting plate and to the first fourth connecting plate by fifth and sixth bolts, respectively, or to the first second connecting plate and to the first third connecting plate by fifth and sixth bolts, respectively;

wherein the first bolt has a first bolt axis which extends perpendicularly towards the first post tube longitudinal axis and the first crossbar longitudinal axis, the second bolt has a second bolt axis which extends perpendicularly towards the second post tube longitudinal axis and the first crossbar longitudinal axis, the third bolt has a third bolt axis which extends perpendicularly towards the first post tube longitudinal axis and the second crossbar longitudinal axis, and the fourth bolt has a fourth bolt axis which extends perpendicularly towards the second post tube longitudinal axis and the second crossbar longitudinal axis;

wherein at least two rosettes for attachment of connection heads of scaffolding components are fixedly welded to each of the first and second post tubes at a mutual spacing corresponding with an integral multiple of a grid dimension of a modular scaffolding;

wherein the first first connecting plate and the second first connecting plate are secured to the first post tube in a region of the first first post tube end, extend away from one another, and are arranged in a first common notional plane which contains the first post tube longitudinal axis, wherein the first second connecting plate and the second second connecting plate are secured to the first post tube in a region of the second first post tube end, extend away from one another, and are arranged in a second common notional plane which contains the first post tube longitudinal axis;

wherein the first third connecting plate and the second third connecting plate are secured to the second post tube in a region of the first second post tube end, extend away from one another, and are arranged in a third common notional plane which contains the second post tube longitudinal axis;

wherein the first fourth connecting plate and the second fourth connecting plate are secured to the second post tube in a region of the second second post tube end, extend away from one another, and are arranged in a fourth common notional plane which contains the second post tube longitudinal axis;

wherein a first connecting body is fixedly welded to the first post tube in a region of one of the first first post tube end and the second first post tube end and surrounds the first outer circumference of the first post tube, wherein a second connecting body is fixedly welded to the second post tube in a region of one of the first second post tube end and the second second post tube end and surrounds the second outer circumference of the second post tube;

wherein the first and the second connecting bodies are associated either with the first crossbar or with the second crossbar; and either the first first connecting plate and the second first connecting plate are fixedly welded either to the first connecting body or to the first connecting body and the first post tube, and the first third connecting plate and the second third connecting plate are fixedly welded either to the second connecting body or to the second connecting body and the second post tube, or the first second connecting plate and the second second connecting plate are fixedly welded either to the first connecting body or to the first connecting body and the first post tube, and the first fourth connecting plate and the second fourth connecting plate are fixedly welded to either the second connecting body or to the second connecting body and the second post tube.

2. The truss frame according to claim 1, wherein the length adjuster is a length adjusting and clamping element having a first length adjusting and clamping element end and a second length adjusting and clamping element end, and a first thread in the region of the first length adjusting and clamping element end and a second thread in the region of the second length adjusting and clamping element end and facing away from the first length adjusting and clamping element end;

wherein the at least one elongate diagonal element comprises a first diagonal rod and a second diagonal rod;

wherein the first diagonal rod has a first diagonal rod end having a second diagonal rod thread;

wherein the second diagonal rod has a second diagonal rod end having a first thread;

wherein the first thread of the length adjusting and clamping element is screwed to the first thread of the second diagonal rod rotatably relative to one another about a first axis of rotation;

wherein the second thread of the length adjusting and clamping element is screwed to the second thread of the first diagonal rod rotatably relative to one another about a second axis (85.2; 78) of rotation;

wherein the first thread of the length adjusting and clamping element, the second thread of the length adjusting and clamping element, the first thread of the second diagonal rod and the second thread of the first diagonal rod are threads turning in the same direction; and wherein the first thread of the length adjusting and clamping element and the first thread of the second diagonal rod (60.2) are screwed together and each have a first pitch, and the second thread of the length adjusting and clamping element and the second thread of the first diagonal rod are screwed together and each have a second pitch of a different size than the first pitch.

3. A plurality of truss frames according to claim 1, constructed as a modular truss girder constructed in a common truss plane, comprising:

(a) at least two pairs of crossbars, identical with one another except in that their length may vary, arranged horizontally in a row and pivotably and detachably secured by the respective bolts to the respective connecting plates; and (b) at least three identical post tubes, each extending perpendicularly to the crossbars;

wherein at least two of the crossbars form a top chord in which the longitudinal crossbar axes are arranged coaxially or in alignment; and wherein at least two of the crossbars form a lower chord in which the longitudinal crossbar axes are arranged coaxially or in alignment.

4. A scaffolding construction comprising at least one of the truss frames according to claim 1.

5. The truss frame according to claim 1, wherein the first connecting body is fixedly welded to the first post tube in a region of the first first post tube end, wherein the second connecting body is fixedly welded to the second post tube in a region of the first second post tube end, wherein one of the at least two rosettes of the first post tube is arranged in a region of the first first post tube end;

wherein one of the at least two rosettes of the second post tube is arranged in a region of the first second post tube end;

wherein the first first connecting plate and the second first connecting plate each have a first receiving slot;

wherein the first third connecting plate and the second third connecting plate each have a second receiving slot wherein the one of the at least two rosettes of the first post tube projects through each of the first receiving slots; and wherein the one of the at least two rosettes of the second post tube projects through each of the second receiving slots.

6. The truss frame according to claim 5, wherein the first first connecting plate and the second first connecting plate are fixedly welded to the first connecting body, the first post tube, and the one of the at least two rosettes of the first post tube, and wherein the first third connecting plate and the second third connecting plate are fixedly welded to the second connecting body, the second post tube, and the one of the at least two rosettes of the second post tube.

7. The truss frame according to claim 1, wherein the first and the second connecting bodies are connecting sleeves, connecting rosettes, or connecting discs.

8. The truss frame according to claim 7, wherein the first and the second connecting bodies are first and second connecting sleeves, respectively;

wherein each of the first and the second connecting sleeves has an outer diameter and an outer surface spanning the respective outer diameter;

wherein a first connecting head of the scaffolding component is releasably connected by a first connecting wedge to one of the at least two rosettes of the first post tube;

wherein a second connecting head of the scaffolding component is releasably connected by a second connecting wedge to one of the at least two rosettes of the second post tube;

wherein a first gap is formed between the first connecting wedge and the outer surface of the first connecting sleeve; and wherein a second gap is formed between the second connecting wedge and the outer surface of the second connecting sleeve.

9. The truss frame according to claim 2, wherein the first thread of the length adjusting clamping element and the first thread of the second diagonal rod are each associated with a first thread type, and the second thread of the length adjusting and clamping element and the second thread of the first diagonal rod are each associated with a second thread type which is different than the first thread type.

10. The truss frame according to claim 9, wherein the first thread of the length adjusting and clamping element and the first thread of the second diagonal rod are each a Dywidag thread, and the second thread of the length adjusting and clamping element and the second thread of the first diagonal rod are each a metric thread.

11. The truss frame according to claim 1, wherein the first connecting body is fixedly welded to the first post tube in a region of the second first post tube end, wherein the second connecting body is fixedly welded to the second post tube in a region of the second second post tube end, wherein one of the at least two rosettes of the first post tube is arranged in a region of the second first post tube end;

wherein one of the at least two rosettes of the second post tube is arranged in a region of the second second post tube end;

wherein the first second connecting plate and the second second connecting plate each have a first receiving slot;

wherein the first fourth connecting plate and the second fourth connecting plate each have a second receiving slot wherein the one of the at least two rosettes of the first post tube projects through each of the first receiving slots; and wherein the one of the at least two rosettes of the second post tube projects through each of the second receiving slots.

12. The truss frame according to claim 11, wherein the first second connecting plate and the second second connecting plate are fixedly welded to the first connecting body, the first post tube, and the one of the at least two rosettes of the first post tube, and wherein the first fourth connecting plate and the second fourth connecting plate are fixedly welded to the second connecting body, the second post tube, and the one of the at least two rosettes of the second post tube.

* * * * *